US007380743B2

(12) United States Patent
Martin et al.

(10) Patent No.: US 7,380,743 B2
(45) Date of Patent: Jun. 3, 2008

(54) MODULE FOR SUPPORTING AND DRIVING A WOUND FOIL MATTER FOR A MACHINE PROCESSING IT

(75) Inventors: Justo Martin, Crissier (CH); Michel Piguet, Renens (CH)

(73) Assignee: Bobst, S.A. (CH)

( * ) Notice: Subject to any disclaimer, the term of this patent is extended or adjusted under 35 U.S.C. 154(b) by 315 days.

(21) Appl. No.: 11/110,555

(22) Filed: Apr. 19, 2005

(65) Prior Publication Data

US 2005/0236511 A1 Oct. 27, 2005

(30) Foreign Application Priority Data

Apr. 23, 2004 (CH) ..... 0718/04

(51) Int. Cl.
*B65H 23/06* (2006.01)

(52) U.S. Cl. ..... 242/420.1; 242/420.2; 242/557; 242/564.5

(58) Field of Classification Search .. 242/420.1–420.3, 242/422.4–422.6, 578, 557, 564.5, 393
See application file for complete search history.

(56) References Cited

U.S. PATENT DOCUMENTS

| | | | | |
|---|---|---|---|---|
| 1,410,825 A | | 3/1922 | Mascord | |
| 2,501,981 A | * | 3/1950 | Wyrick | 242/421.9 |
| 3,823,934 A | | 7/1974 | Parenti et al. | 270/18 |
| 4,139,165 A | * | 2/1979 | Dyck | 242/421 |
| 4,304,369 A | * | 12/1981 | Landsness | 242/421.3 |
| 4,341,586 A | | 7/1982 | Koutonen | 156/518 |
| 4,441,664 A | * | 4/1984 | Stohlquist | 242/421.8 |
| 4,492,138 A | | 1/1985 | Breuers et al. | 83/203 |
| 5,123,602 A | * | 6/1992 | Skalleberg et al. | 242/393 |
| 6,607,158 B1 | * | 8/2003 | Fischer | 242/420.1 |

FOREIGN PATENT DOCUMENTS

| | | |
|---|---|---|
| DE | 1 760 900 | 7/1968 |
| EP | 741096 | 4/1996 |

* cited by examiner

*Primary Examiner*—Sang Kim
(74) *Attorney, Agent, or Firm*—Ostrolenk, Faber, Gerb & Soffen, LLP

(57) ABSTRACT

A module for supporting and driving a wound foil matter for a machine processing it. The module is entirely located outside that machine. The module comprises a bearing structure in which a plurality of reel stands are arranged. Each stand supports at least one reel. At least one drive device for the reels which are mounted freely rotatably on their respective reel stands. Each reel is repositionable on supports in the module and is also motor driven to rotate. At least one additional member for processing the foil matter.

10 Claims, 3 Drawing Sheets

MODULE FOR SUPPORTING AND DRIVING A WOUND FOIL MATTER FOR A MACHINE PROCESSING IT

BACKGROUND OF THE INVENTION

The present invention refers to a module for supporting a wound foil for a machine processing, the foil, and more particularly for a machine using stamping foils for manufacturing packaging.

Such a machine is used for the embossing and the transfer by pressure of film portions, preferably of metal, coming from such foils onto a substrate of paper, plastic material or more particularly cardboard. These operations are for example carried out in a machine equipped with a platen press which processes plate-like elements, such as sheets of cardboard, for the foil stamping of given patterns. These patterns come from a stamping foil led between the travelling plane of the plate-like elements and the upper beam of the press. In intermittent vertical movements, the movable lower platen presses the stamping foil against each cardboard sheet between printing plates and corresponding counterparts in order to deposit the metallic layer of the stamping foil in correspondence with the patterns of the printing plates. Once the transfer has been carried out, the lower platen lowers and the stamped cardboard sheet is withdrawn from the platen press leaving the space for a new sheet. During the same period of time, the stamping foil is moved so that a new blank sheet is placed in correspondence with the printing plates. The diecutting and transfer operation of the foil can then be repeated.

Such a machine can also be used for the diecutting of cardboard sheets in a succession of operations each carried out in an adjacent station. This succession of operations generally comprises the infeed of the sheet into the press, its diecutting by tools arranged on the platen, the stripping of waste by specific tools and the delivery in stacks of the diecut sheet elements. In order to optimize the possibilities of such a machine, it is known to convert it so that the initial diecutting station becomes a stamping station for stamping foils by replacing the diecutting tools by a stamping device and the tools of the stripping station by a device for loading and unwinding stamping foil reels. Such a conversion is illustrated by the machine described in patent EP 741'096.

The arrangement of a foil loading and unwinding device in the stripping station within such a machine is described in detail in patent EP 741'096. This device in particular comprises a pair of parallel vertical arms between which crossbars are arranged to be used as supports for a plurality of stamping foil reels. The foil widths are typically of the order of 5 to 20 cm. It should be noted that these stamping foils carrying patterns, or foils called diffraction foils, are generally realized by depositing, through printing, a decorative metallic layer on a substrate consisting of a flexible material, for example plastic material. Because of the way in which they are made, these stamping foils include a fine connecting line issuing from the cylindrical printing plate carrying the pattern to print which, obviously, cannot cover the 360° of the plate cylinder. Therefore, this fine connecting line will appear at each revolution of the plate cylinder and it should be prevented that this connecting line comes in conflict with one of the patterns to stamp.

Due to the transverse arrangement of the rotation axes of the reels with respect to the longitudinal axis of the machine, the unwinding of the foils takes place parallel to the travelling direction of the sheets to stamp. The transport of these foils requires intermittent unwinding and advancing means generally comprised of rollers against which the foils are seized by pressure rollers. The motorized drive of these rollers allows intermittent feed of these foils. According to the desired speed profiles of the respective foils, it is possible to provide a plurality of advancing rollers so that each foil can be independently driven. When using wider foils, it is necessary to provide a plurality of pressure rollers per foil. These pressure rollers are mounted in a slidable manner on transverse axes, so that they can be positioned in completely independent manner. However, the whole apparatus formed by the reel loading and supporting device, the idling rollers, the drive rollers, their motorization as well as the pressure rollers adjustable in position, requires related operations when such a device is to be mounted within a diecutting machine for its conversion into a stamping machine. Since these conversion operations cannot be performed when the machine is running, they immobilize the machine for hours and contribute to an increase in price of the future production, mainly for production of small series.

Although the majority of the metallic layers deposited on the packaging can be supplied from narrow foils, generally not exceeding 30 cm, sometimes wider stamping foils have to be used, typically of the order of 50 to 70 cm, or a plurality of narrow foils arranged side by side have to be used, the total width of which approaches this magnitude.

However, the use of wide reels raises handling problems. Because of their weight, it is obviously impossible to move these reels with the physical strength of one man for positioning them in the machine. Thus, lifting means should be used, such as hoists or small vehicles able to easily move heavy loads. However, the positioning of such reels by these means makes the handling them in a machine delicate, and sometimes even impossible, either because of lack of space around the machine, or due to the impossibility of access inside the machine which was not intended for receiving such means.

SUMMARY OF THE INVENTION

The object of the present invention is to at least partly obviate the above drawbacks by proposing a new module for supporting and driving a foil matter for a machine processing it. The object of the present invention preferably offers an optimum access for loading and unloading of even big-sized reels by any conventional means. The handling of such reels should neither be limited nor made impossible by a restricted adjacent space or by an impossible way of access. The object of the present invention should also allow its preparation when the machine is running so as to reduce as much as possible the idle time of the machine under conversion. It should offer a quick and easy convertibility of the diecutting machine into a stamping machine, and vice versa. It should also offer greater flexibility as regards the arrangement of possible optional members or devices, such as, members for detecting connecting lines on the stamping foil, or on the diffraction foil, which devices require considerable spaces. Finally, it should be easily adaptable to diecutting machines which have never been converted into stamping machines before.

These aims are achieved owing to the present invention of a module for supporting and driving a wound foil matter for a machine processing it. The module is entirely located outside that machine. The module comprises a bearing structure in which a plurality of reel stands are arranged. Each stand supports at least one reel. At least one drive device for the reels which are mounted freely rotatably on their respective reel stands. Each reel is repositionable on supports in the module and is also motor driven to rotate. At least one additional member for processing the foil matter.

Other features and advantages of the present invention will become apparent from the following description of the invention which refers to the accompanying drawings.

BRIEF DESCRIPTION OF THE DRAWINGS

The invention will be more clearly understood from the study of a preferred embodiment given by way of non-limitative example and illustrated by the accompanying drawings, in which.

DETAILED DESCRIPTION OF EMBODIMENTS OF THE INVENTION

Figure 1:
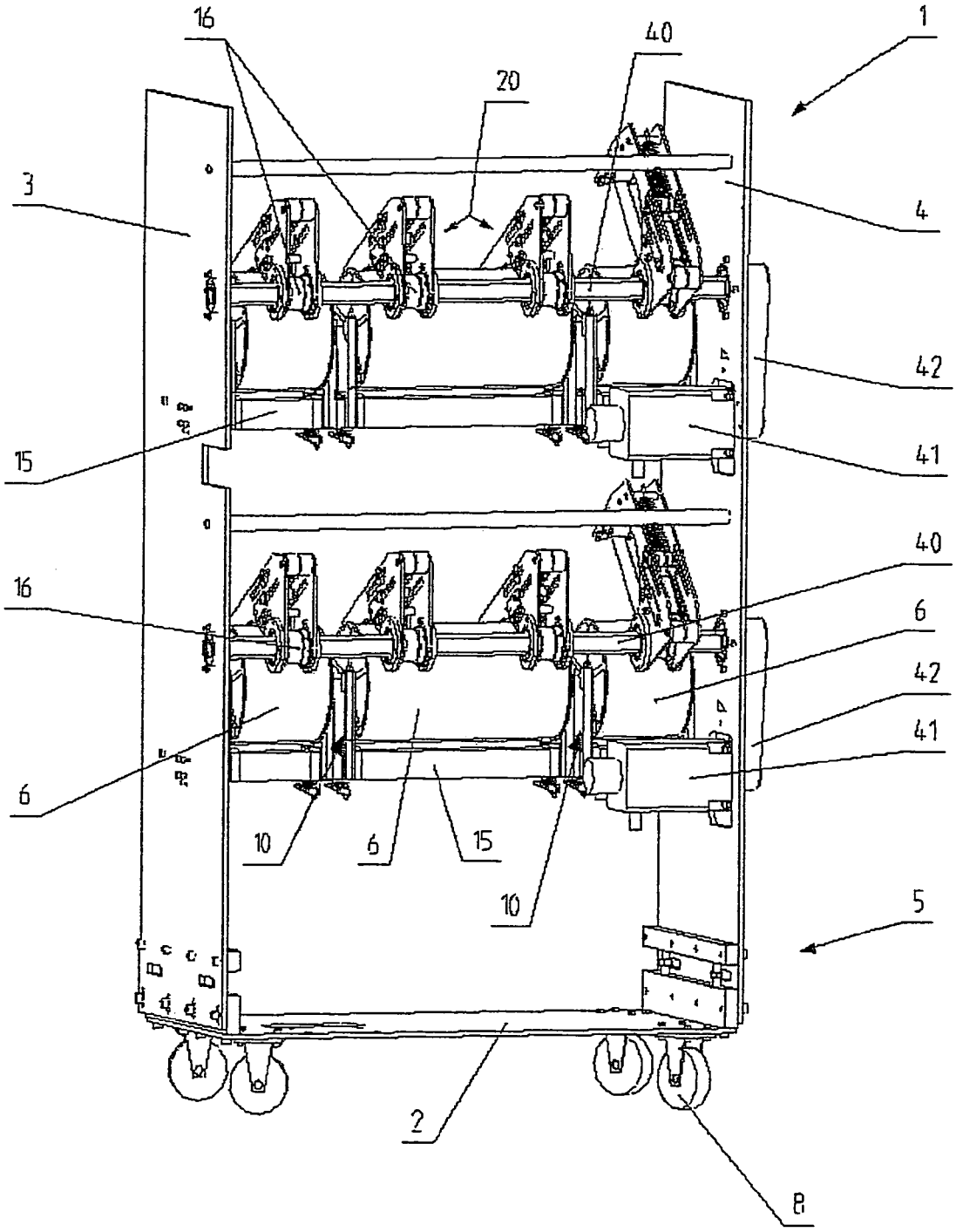
FIG. 1 is a front perspective view of the module of the invention.

FIG. 1 shows a module of the present invention, seen from the front, comprising an independent module 1, which is located entirely outside an adjacent machine (not shown) that processes a foil matter. Thus, this module is to be arranged outside that machine and outside its longitudinal axis, and preferably at the level of the stripping station that is normally provided in any high-capacity diecutting machine. For use of the module, this station will have been converted into a space provided with idling rollers arranged for example at 45° with respect to the longitudinal axis of the machine. To this end, the foil or foils coming from the module 1 can enter into the machine by its side, through an open window in one of the side walls of its frame, before being deflected by the idling rollers in register with the longitudinal axis of this machine.

The module 1 comprises a frame comprised of a base 2 and two side walls 3, 4 forming a bearing structure 5, in particular for a plurality of reels 6 from which comes the said foil matter. Each reel is supported by a reel stand 10 and is rotated by at least one drive device 20.

Figure 2:
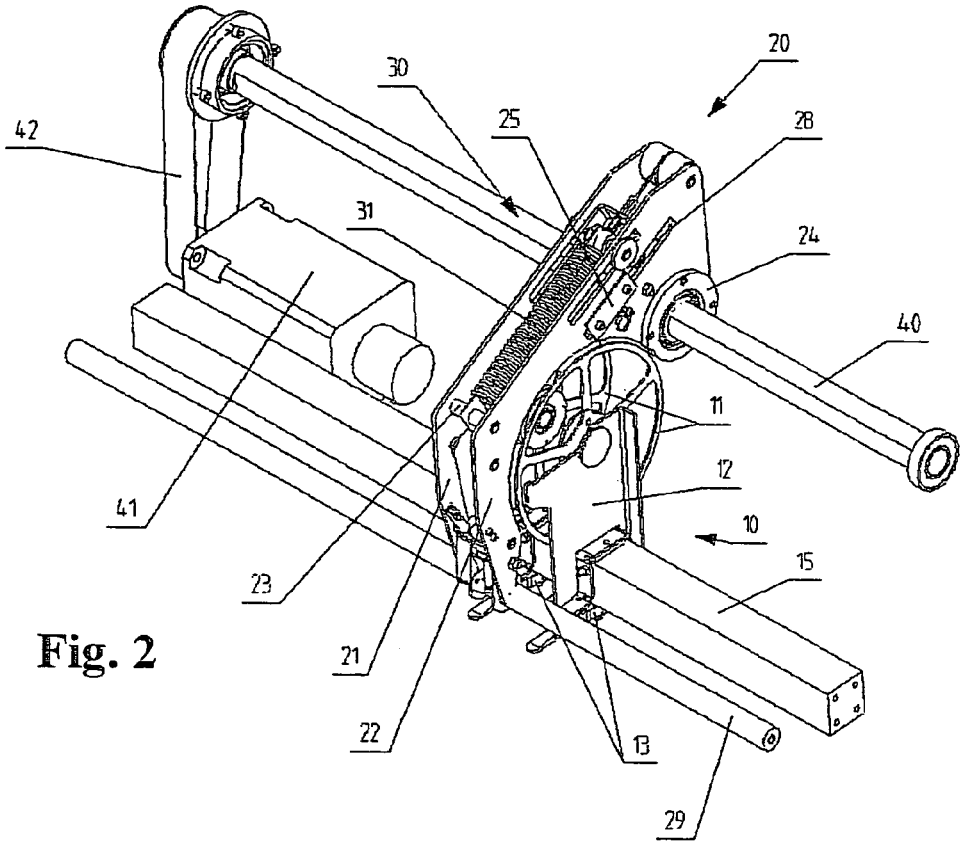
FIG. 2 is a rear perspective view of a part of the module of the invention showing a reel stand arranged on a transverse bar, an associated drive device and a preferred kinematic chain.
Figure 3:
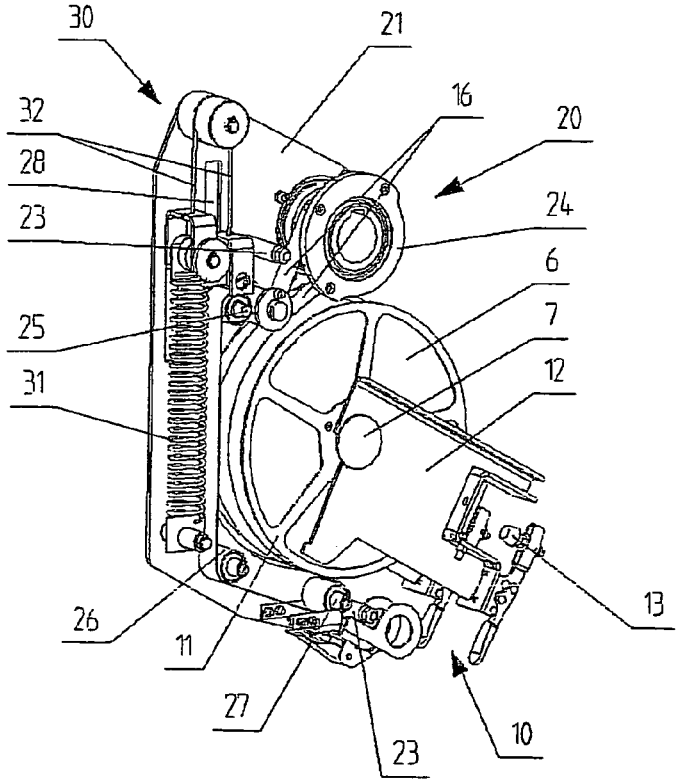
FIG. 3 is a partial perspective view of a detail of an alternative of the illustration in FIG. 2.

FIGS. 2 and 3 show more in detail, and from the rear, one of the drive devices 20 and the reel stand 10 associated with this device. This reel stand is comprised of two flanges 11 which allow supporting the reel 6 by its hub 7. This reel is mounted free rotatable by means of flanges 11, each arranged on a support 12. These supports are mounted on a reel stand bar 15 by means of clamping members 13, such as screws or knurled knobs. The reel stands 10 are adjustable along this bar 15 which, as shown in FIGS. 1 and 2, is preferably of square section and is supported at its ends by the walls 3 and 4 of the bearing structure 5. Because such reel stands 1 are movable independently from one another, a reel 6 of the module 1 can easily be adjusted, positioned and removed without having to move other already positioned reels. However, as an alternative, a reel stand could directly be made up of a shaft on which the various reels would be arranged successively.

Referring to FIGS. 2 and 3, the drive device 20 comprises two side members 21, 22 between which an endless belt 16 rotates, as better shown in FIG. 3. This belt is arranged so as to be constantly in contact with a rear portion of the external circumference of the reel 6. By friction with this cylindrical portion, the reel is rotated by the action of the belt 16 and due to this, the foil matter can be unwound for being used in an adjacent machine, and inversely rewound if it comes from this machine.

The side members 21, 22 are held together by spacers and thereby allow the arrangement between the members of a drive member 24 for rotating the belt 16. Starting from the drive member 24, the belt travels respectively around a tightening roller 25, then around a plurality of return rollers 26 among which is a lower return roller 27 at the lower end of the path slightly below the reel 6, before the belt rises to the drive member 24 by resting against a cylindrical portion of the reel 6. When the foil matter is unwound from the reel, reducing its diameter, the length of the path of the belt between the lower return roller 27 and the drive member 24 constantly varies. The aim of the tightening roller is to permanently compensate these variations. To this end, it is mounted for sliding motion along an oblong opening 28 and is connected to a tightening mechanism 30. This mechanism can be equipped with an elastic means, such as a traction spring 31, connected to the tightening roller 25 by a cable 32.

As better shown in FIG. 2, the drive device 20, which is adjustable between the walls 3, 4 of the bearing structure 5, is supported at one end on a supporting bar 29 and at the other end via the drive member 24. The supporting bar 29 is fixedly held between the walls of the bearing structure 5. The drive member 24 preferably comprises a bushing crossed by an advancing shaft 40. This advancing shaft is also held between the side walls 3, 4 of the module 1 and is connected at one end to an electric motor 41 by an advancing belt 42. This electric motor will control the drive device or adjacent drive devices 20 associated with the same advance shaft 40, via corresponding drive members 24.

Advantageously, the bearing structure 5 is mounted on casters 8 enabling an increase in the mobility of the module 1 and to allow, if required, allowing its moving in a released space, free of any obstruction. As shown in FIG. 1, the module of the present invention is equipped with a plurality of reels 6 distributed on two stages or levels. However, it will be noted that another arrangement of these reels, on only one or a plurality of stages, would also be possible. As shown in FIG. 1, the number of drive devices per reel can be varied at will, according to the width of the foil, its unwound length, its diameter or the drive rate for example. Thus, the drive performances of the reels can be considerably increased by using a plurality of drive devices for controlling the reels. The coupling of a plurality of devices on a same reel also allows to better control the inertia possible to be produced by this reel when it is being rotated and, therefore, also allows higher feed speeds.

By means of additional belts, for example, to couple a plurality of advancing shafts 40 together so as to increase the mechanical drive power applied to certain reels, it is also possible to improve the drive capacities of the reels. That can be particularly useful when the motors 41 are dimensioned to deliver average power, whereas in the case of the drive of a reel having a very large diameter, for example a higher power would be necessary.

According to the embodiment described hereinbefore, the reels 6 which are arranged on the same advancing shaft 40 are simultaneously driven by the same motor 41. Alternatively however, each reel can be independently driven so as to multiply the number of different drive speeds and rates that the module 1 can render simultaneously. To this aim, it is possible to provide advancing shafts 40 so that they are not comprised of a single tube but of a plurality of concentric tubes having different diameters and being rotatable independently from one another on successive bearings fixedly attached to these tubes. Thus, the advancing shaft is comprised of different sections, each of which is independently driven. Another possible embodiment is to equip some or all of the drive devices 20 with an electric motor for each belt 16. Therefore, each drive member 24 of each drive device 20 can be controlled by an independent electric motor 41, which, for example, may be directly mounted on the drive device. Such an arrangement thus allows differentiated control of the unwindings of the reels concerned in order to benefit from distinct speeds and rates according to the specific needs of these reels.

With the features of the present invention, every advancing shaft and every reel stand are easily accessible. Therefore, handling means, such as pallet trucks, elevators or hoists, can advantageously be used for the loading/unloading of heavy reels without fear that the access would be restricted, difficult or even impossible. The release available around the module of present invention thus offers technical and ergonomic perspectives which have been unthinkable with a module that is instead confined inside the machine that processes the foil matter.

Advantageously, the design of an external unit of the machine allows multiplying of the possibilities of such a module, as compared with a reel loading device installed within the machine. As an example, the diameter of the reels of the foil matter or the number of supporting shafts for these reels is not limited by a finished volume, determined by the space available in a machine between the walls of its frame. Optionally, it is also possible to provide a special arrangement for heavy reels, of very large diameter, i.e. of the order of 400 mm. To this aim, such an arrangement should be placed in the bottom part of the module, the nearest possible at ground level so that, for example, the lifting stroke of a pallet truck is sufficient for more easily positioning the reel in question.

Advantageously, the drive of the reels in the module of the present invention does not require any adjusting operation during production. That is generally not the case with the current systems which use mechanical brakes to control the inertia of the reels at each speed change.

More advantageously, due to its position outside the machine, the module of the present invention is entirely accessible for preparation of a job to come as well as for handling operations. Therefore, it is possible to work when the machine is running on the module, without requiring the immobilization of the machine during diecutting operation of the latter.

Owing to the dislocation outside the machine of the unwinding or rewinding function of the foil matter, it is advantageously possible to keep a part of the used devices and members in machine when it is configured for diecutting-waste stripping. Thus, the conversion of the machine configured for diecutting and stripping into one configured for stamping and vice versa is even easier and quick to realize. Moreover, it will be noted that the modification and the adaptation of diecutting machines not being equipped with stamping system is also facilitated.

Figure 4:
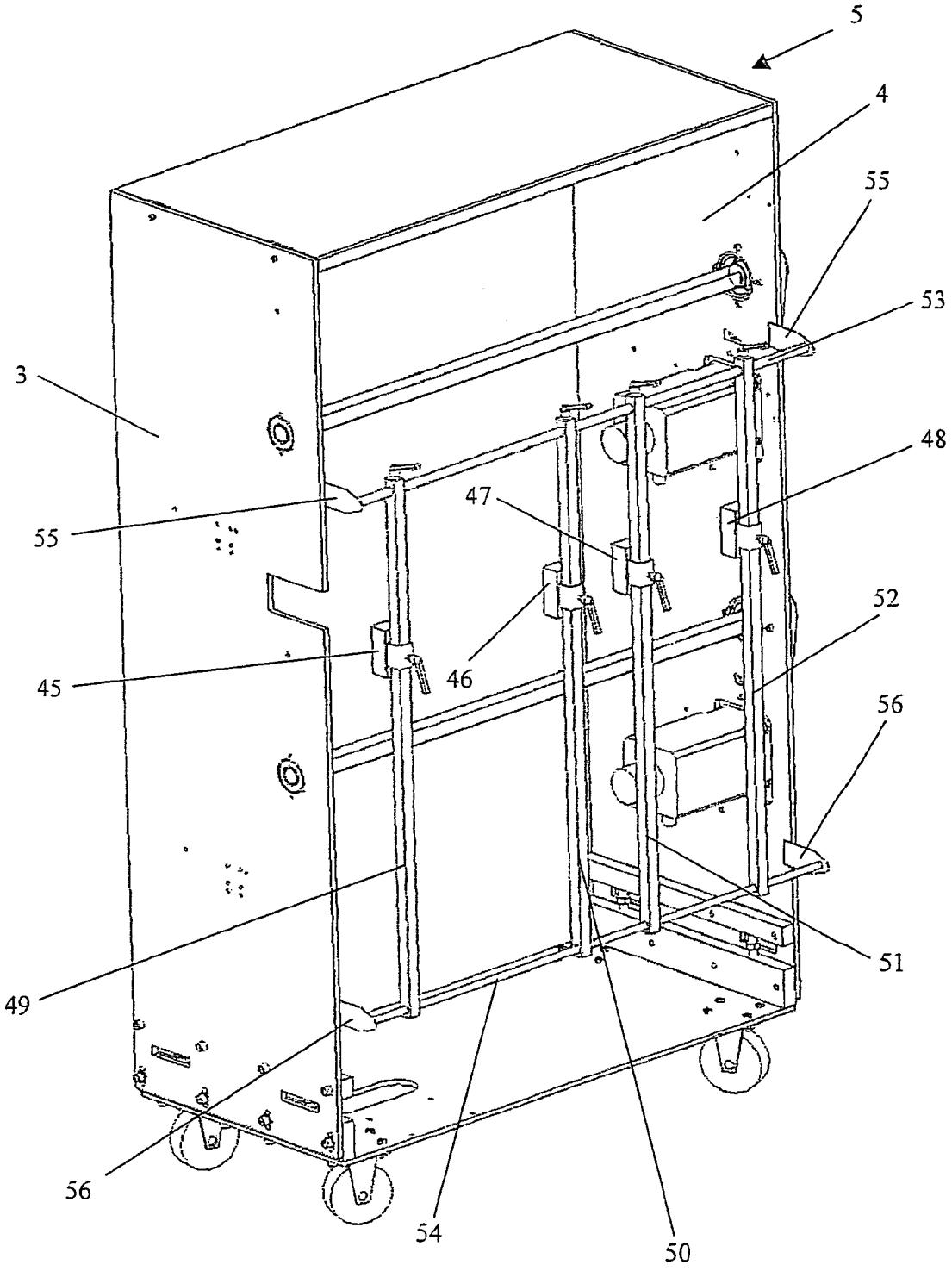
FIG. 4 is a simplified perspective front view of the module of the invention.

Among the numerous advantages of the arrangement of such a module, outside the machine, it will also be noted that on the one hand, the space thus released inside the machine can be utilized for other purposes for the adaptation and the arrangement of various options and on the other hand, the release of the space surrounding the module can also be utilized for adding a whole range of additional members. Among these members, examples include narrow belt drives for reels of low width, additional unwinding axes for reels mounted on original shafts, or more, such as illustrated in FIG. 4, specific scanning cells 45, 46, 47, 48 for the detection of patterns or connections of special foils such as holographic foils or those called diffraction foils. As regards this last case, it will be noted that the scanning and the register of connections and holographic patterns of the diffraction foils require a setting displacement of the optical cells 45 to 48 which is much more important that in the case of scanning only the positions of the holographic patterns. To this aim, and in order to obtain a sufficient release allowing the observance of optimal spacings, the scanning cells 45 to 48 are arranged so as to be slidable respectively along vertical bars 49, 50, 51, 52. The vertical bars 49 to 52 are mounted so as to be slidable laterally, on two crossbars 53, 54 carried by supports 55 and 56 fixed to the walls 3 and 4 of the bearing structure 5. Actually, with the modules confined inside these machines, it is often impossible to obtain a sufficient release allowing the observance of these optimal spacings. However, with the object of the present invention, the external module can advantageously be used as support for this kind of supplementary devices without restriction to a limited surrounding space.

It should be noted that the module described is preferably used as an unwinding module for transferring a foil matter from this module to a machine processing it. However, it will be mentioned that the reverse path, if required, is perfectly realizable with the same module by simply reversing its initial function as an unwinding module into a rewinding module for used foil matter, for example.

Finally, it will be understood that the denomination foil matter covers the use of both a single foil of large width for example, as well as a plurality of foils or tapes arranged side by side, with or without interstitial spacings. Moreover, even if the machine, in which the device of the present invention has been described, clearly refers to a platen press processing plate-like elements, it will be noted that the use of this device is not limited to such machines.

Numerous improvements can be applied to the device of the present invention within the scope of the claims.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A module for supporting and driving a wound foil matter, the module being entirely located outside a machine which uses the foil matter, the module comprising:

a bearing structure, a plurality of reel stands arranged in and supported by the bearing structure, each reel stand being operable to support at least one reel;

at least one drive device for the reels and each reel being mounted freely rotatably on its respective reel stand; and at least one additional member for processing the foil matter, and wherein the bearing structure includes walls, the at least one drive device being laterally adjustable between the walls of the bearing structure, each of the at least one drive device comprising a belt operable for rotating the reel on the reel stand and an associated drive member controlled by an electric motor for driving the belt to rotate the reel, the at least one drive member comprising a plurality of the drive members in a plurality of adjacent drive devices and the drive members being controlled by the electric motor; and an advancing shaft connecting the drive members in the plurality of adjacent drive devices.

2. A module according to claim 1, wherein at least one bar is held between the walls of the bearing structure; and the reel stands are movable independently from one another and are adjustable along the respective at least one bar.

3. A module according to claim 1, further comprising a plurality of advancing shafts coupled together in order to increase the mechanical drive power transmitted to the reels.

4. A module according to claim 1, further comprising an independent electric motor connected to control each drive member of each drive device.

5. A module according to claim 1, wherein the bearing structure is equipped with casters.

6. A module according to claim 1, wherein the additional member for processing the foil matter comprises scanning cells operable for detecting patterns or connections of particular foils, vertical bars of the bearing structure and crossbars carried by supports fixed to walls of the bearing structure, the scanning cells being arranged so as to be slidable respectively along the vertical bars and being also mounted so as to be slidable laterally on the crossbars.

7. A module for supporting and driving a wound foil matter, the module being entirely located outside a machine which uses the foil matter, the module comprising:

a bearing structure, a plurality of reel stands arranged in and supported by the bearing structure, each reel stand being operable to support at least one reel;

at least one drive device for the reels and each reel being mounted freely rotatably on its respective reel stand; and at least one additional member for processing the foil matter, and wherein the bearing structure includes walls, the at least one drive device being laterally adjustable between the walls of the bearing structure, each of the at least one drive device comprising a belt operable for rotating the reel on the reel stand and an associated drive member controlled by an electric motor for driving the belt to rotate the reel, and wherein the belt comes in contact with a portion of a circumference of the reel; and a tightening roller arranged within the drive device is operable to constantly tighten the belt.

8. A module according to claim 7, wherein at least one bar is held between the walls of the bearing structure; and the reel stands are movable independently from one another and are adjustable along the respective at least one bar.

9. A module according to claim 7, wherein the bearing structure is equipped with casters.

10. A module according to claim 7, wherein the additional member for processing the foil matter comprises scanning cells operable for detecting patterns or connections of particular foils, vertical bars of the bearing structure and crossbars carried by supports fixed to walls of the bearing structure, the scanning cells being arranged so as to be slidable respectively along the vertical bars and being also mounted so as to be slidable laterally on the crossbars.

* * * * *